United States Patent [19]

Duran

[11] Patent Number: 4,473,012

[45] Date of Patent: Sep. 25, 1984

[54] APPARATUS AND METHOD FOR REMOVING CREMATED REMAINS FROM A CREMATORY FURNACE

[76] Inventor: Reginald F. Duran, 2051 Skyline Dr., Fullerton, Calif. 92631

[21] Appl. No.: 514,498

[22] Filed: Jul. 18, 1983

[51] Int. Cl.[3] ..... F23G 1/00

[52] U.S. Cl. ..... 110/194; 110/165 R; 110/259; 110/346

[58] Field of Search ..... 110/194, 165 R, 165 A, 110/259, 346

[56] References Cited

U.S. PATENT DOCUMENTS 3,808,985 5/1974 Raber ..... 110/194

3,837,301 9/1974 Falling ..... 110/194

*Primary Examiner*—Edward G. Favors

*Attorney, Agent, or Firm*—Hubbard & Stetina

[57] ABSTRACT

This invention provides a system for breaking and removing cremated remains from a crematory furnace. The system includes means for breaking cremated remains into fragments for transmission through a vacuum line into a grinder which reduces the fragments into fine particles. A filter collects fine particles output from the vacuum line; and after completion of the grinding process, the output of the grinder and the particles collected in the filter are collected in a receptacle for removal from the system.

12 Claims, 7 Drawing Figures

Fig. 3
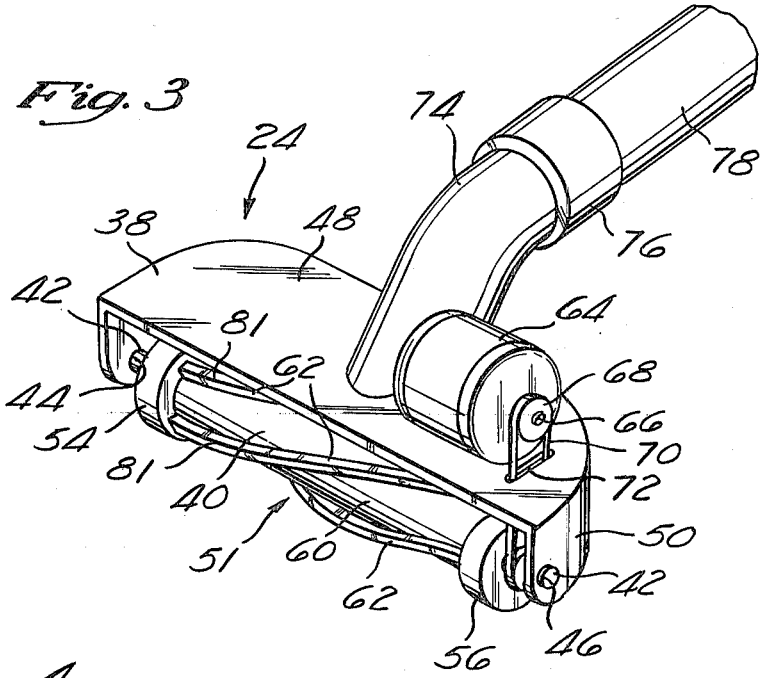
Fig. 4
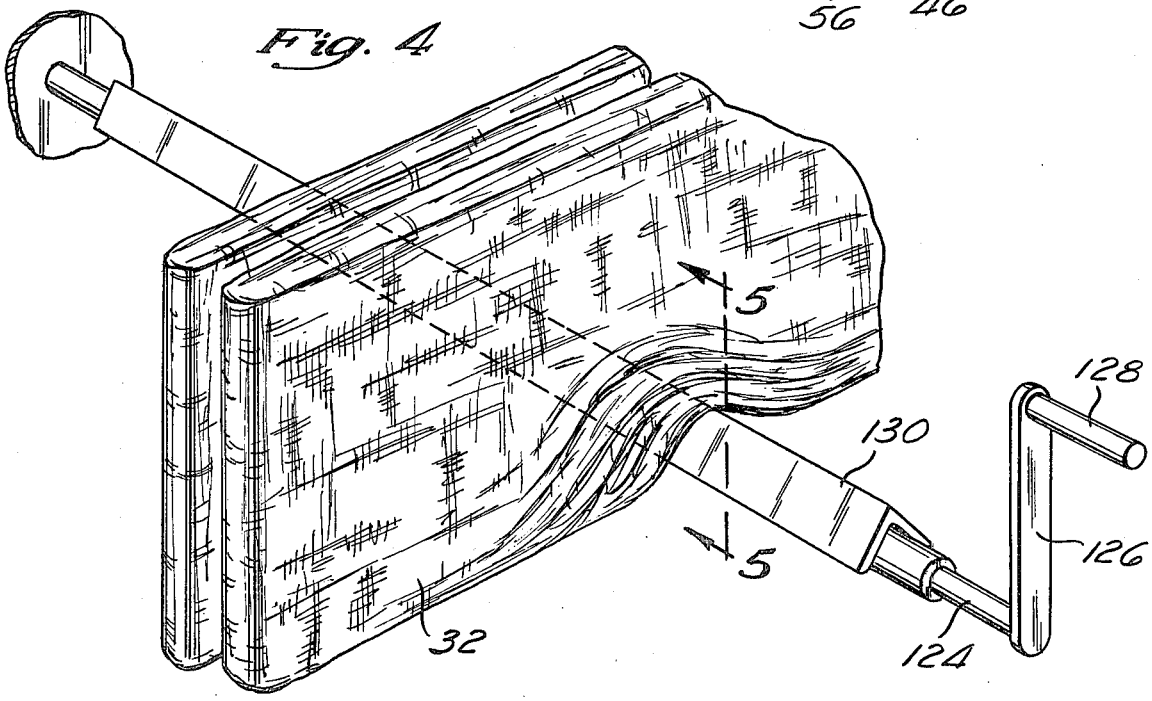
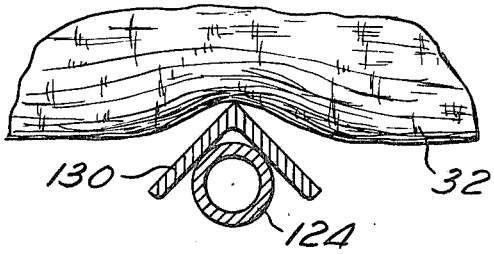
Fig. 5

APPARATUS AND METHOD FOR REMOVING CREMATED REMAINS FROM A CREMATORY FURNACE

BACKGROUND OF THE INVENTION

This invention relates generally to devices for removing incombustible material from a furnace and particularly to a device for removing calcinated remains from a crematory furnace.

Preparation of a body for cremation typically involves placing the body in a wooden or cardboard box, which is then positioned in the crematory so that flame from a gas jet burns the combustible portions of the body. The temperature in the crematory typically attains a value in the 1,800 degree to 2,000 degree Fahrenheit range. At such temperatures the soft tissue of the body burns rapidly, or flashes, but the time required to burn the combustible portions of the hard bones of a body is about 1½ to 2 hours. The interior walls of the crematory furnace are typically lined with a fire brick capable of withstanding the high temperature necessary to cremate a body. A crematory furnace ordinarily has a primary gas jet which supplies a fuel for burning the combustible body tissue and a secondary gas jet which supplies fuel for burning combustible vapors formed during combustion of body tissues.

Cremation of a body forms hard, brittle calcinated bone remains which must be broken and subsequently ground up to produce the "ashes" ordinarily expected from cremation. Prior methods for forming the ashes required a person to enter the crematory furnace after the body has been cremated and the interior of the crematory has cooled to about 500 degrees Fahrenheit or below. A typical crematory furnace requires about 30 minutes to cool from 2,000 degrees Fahrenheit to 500 degrees Fahrenheit. In order to endure temperatures of 500 degrees Fahrenheit, a person must wear protective clothing, gloves and head and face coverings. Even with available protective coverings, crematory personnel sometimes contact material hot enough to cause burns and discomfort. Combustion of a body ordinarily creates a fine dust, which permeates the atmosphere inside the crematory, and which may cause problems in removing material from the crematory furnace.

The process of forming the ashes of the bone remains begins with a person striking the cremated bone remains with a device such as a steel rake to break them into pieces of acceptable size. The person then uses the rake and a broom to sweep the broken up cremated bone remains into a receptacle for removal from the crematory furnace. The pieces of the cremated remains are then ground into particles of suitable size for display in an urn or for disposal.

The primary disavantages with the prior method discussed above for forming such ashes are the exposure of personnel to heat and dust inside the crematory furnace and the time required for the interior of the crematory furnace to cool to a temperature low enough for a person to enter into it to begin the process of breaking the calcinated bone remains. The half hour cool down period represents an inefficient use of expensive crematory equipment.

SUMMARY OF THE INVENTION

The present invention overcomes the disadvantages of the prior art by providing a system which permits removal of the cremated remains from the crematory furnace after only a few minutes from the time combustion is completed. The removal process if controlled from outside the crematory furnace and does not require a person to enter the hot furnace, thereby preventing exposure of personnel to dust and heat inside the furnace.

The invention comprises a roller and blade device attached to an open end of a vacuum line. The roller and blade device breaks the cremated bone remains into pieces suitably sized for passage through the vacuum line to a filter. The filter has a plurality of filter elements for entrapping fine particles of the material drawn into the vacuum line to prevent them from being exhausted into the atmosphere. Pieces of cremated bone remains that are too large for retention in the filter are input from the vacuum device into a grinder which grinds the remains into acceptably sized particles. The small particles entrapped by the filter are then combined with the output of the grinder.

Thus, the present invention provides a device which removes approximately 99% of the material remaining after cremation of a body from a crematory furnace. The invention provides a significant time saving over the prior method of removing the cremated bone remains from a crematory furnace and in forming the ash product that people expect to receive from a crematorium. The invention accomplishes the foregoing advantages without exposing personnel to excessive heat or to harmful dust.

BRIEF DESCRIPTION OF THE DRAWINGS

FIG. 3 is a perspective view of a device for breaking cremated remains into sizes suitable for removal from the crematory furnace of FIG. 1 by a vacuum line;

FIG. 4 is a perspective view of a portion of a filter arrangement for collecting small particles of calcinated bone remains;

FIG. 5 is a cross-sectional view taken along line 5—5 of FIG. 4;

DESCRIPTION OF THE PREFERRED EMBODIMENT

Figure 1:
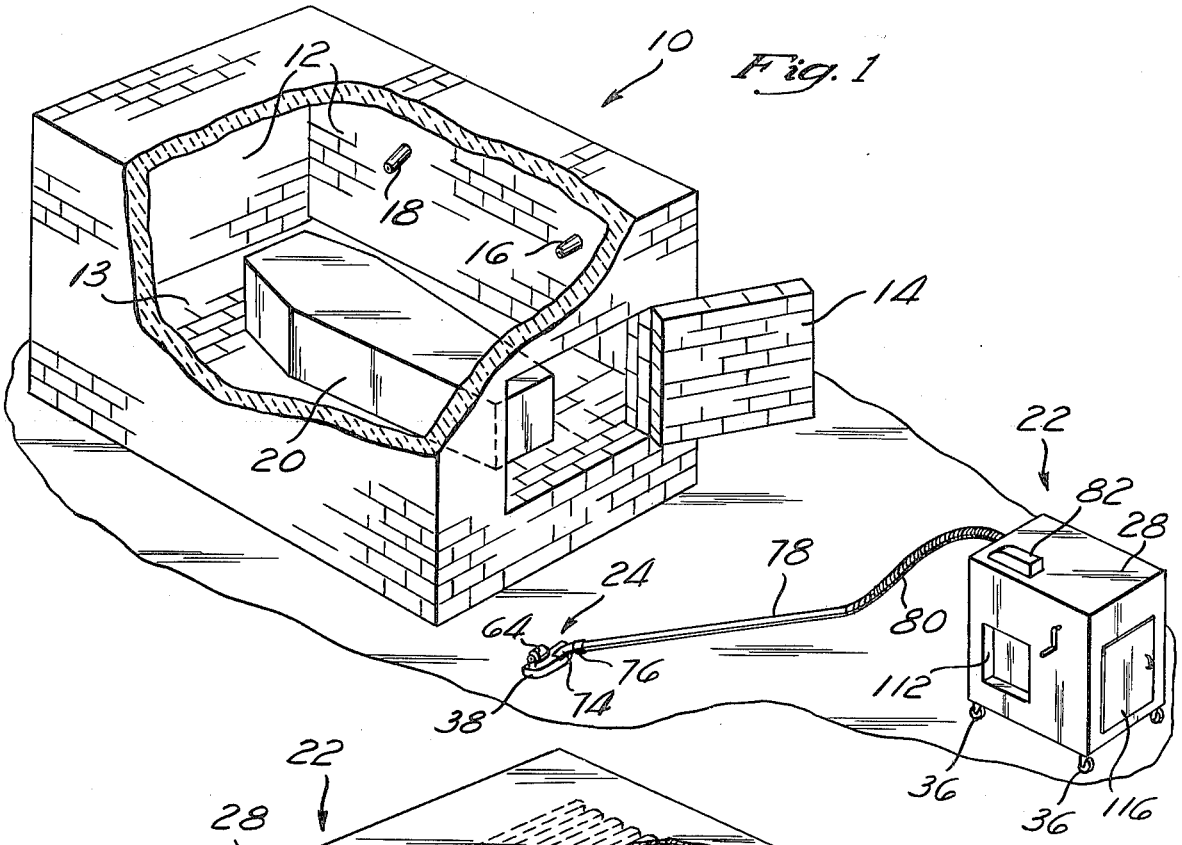
FIG. 1 is a partially cut away perspective view illustrating the interior of a crematory furnace and apparatus for removing cremated remains therefrom.

Referring to FIG. 1, a crematory furnace 10 includes interior walls 12 and a floor 13 lined with fire brick, a door 14, a primary gas jet 16 and a secondary gas jet 18. A body (not shown) to be cremated is placed inside a wooden or cardboard box 20 which is then placed inside the crematory furnace 10.

A suitable fuel from a source (not shown) remote from the crematory furnace 10 is supplied to the primary gas jet 16 and ignited to cremate the body and to burn the box 20. Combustion of fuel supplied through the primary gas jet 16 causes the temperature inside the crematory furnace 10 to attain a value of 1,800 to 2,000 degrees Fahrenheit. At such temperatures, the box 20 and the soft tissue of the body burn rapidly, but approximately 1½ to 2 hours are required to burn the combustible material in the bone tissue of the body. Cremation of the body results in formation of some combustible gases and leaves behind incumbustible bone remains. After the flame from the primary gas jet 16 has burned essentially all of the combustible material in the body, fuel supplied to the secondary gas jet 18 is ignited to burn the combustible gases formed during cremation of the body by flame from the primary gas jet 16.

After the cremation and gas burning processes are completed, the door 14 is opened to permit removal of the cremated bone remains from the crematory furnace 10.

Figure 2:
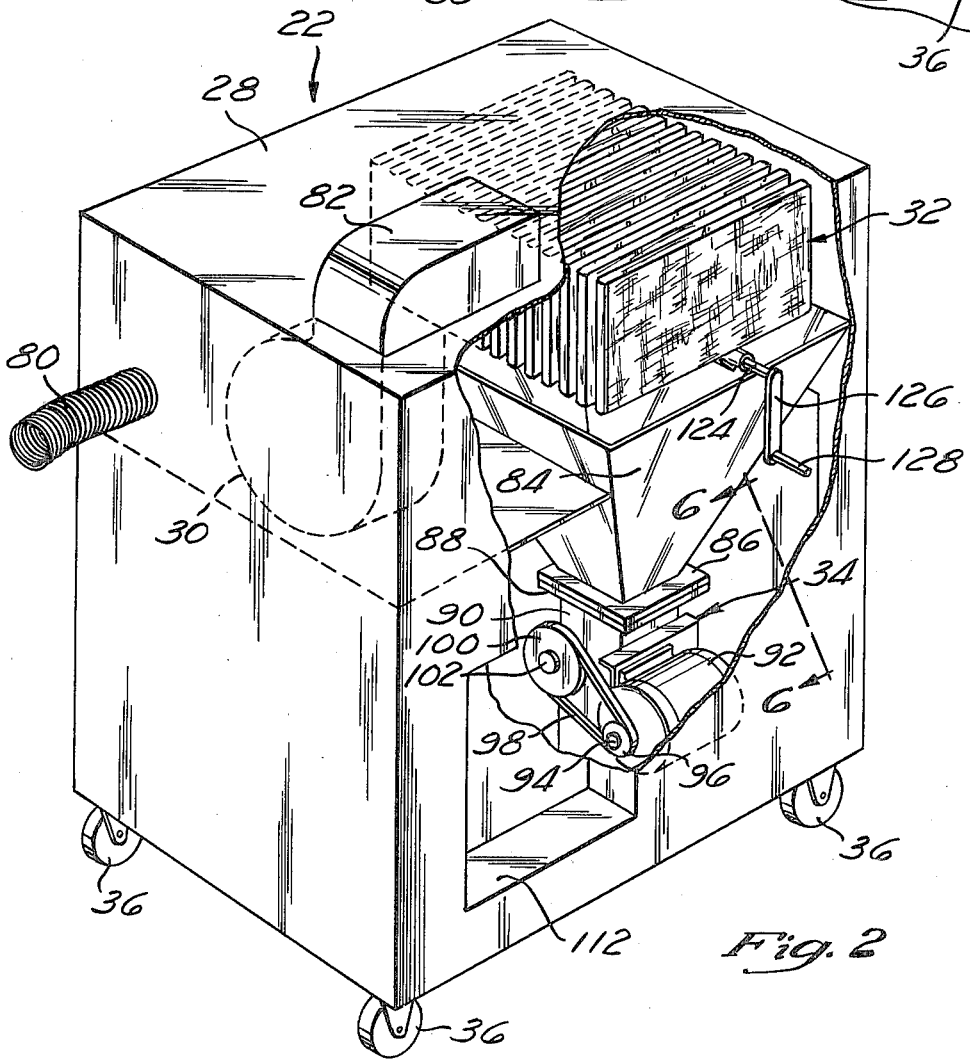
FIG. 2 is a cut away perspective view of the apparatus of FIG. 1 for removing and processing cremated remains from a crematory furnace.

FIG. 1 illustrates a device 22 for removing the cremated bone remains from the crematory furnace 10. Referring to FIGS. 1, 2 and 3, the device 22 for removing the cremated bone remains comprises a motor-driven reel device 24, a vacuum line 78 connected between the motor-driven reel device 24 and a housing 28. The housing 28 encloses a blower motor 30, a filter array 32, and a grinder assembly 34. The housing 28 may be conveniently mounted upon a plurality of casters 36 so that the device 22 may be conveniently rolled from one crematory furnace 10 to another or rolled into position for storage when it is not in use.

FIG. 3 illustrates structural details of the reel assembly 24, which is formed of a material such as stainless steel to withstand the temperatures inside the crematory furnace 10. The reel assembly 24 includes a reel housing 38 having a reel 40 rotatably attached thereto by means of an axle 42 positioned in a pair of openings 44 and 46 on opposing sides of the reel housing 38. The reel housing 38 comprises a generally planar upper portion 48 and a sidewall 50 extending generally perpendicularly therefrom to form a closed upper surface, a closed rear surface and a front and bottom opening 51. The reel 40 includes a pair of rollers 54 and 56 mounted on the axle 42 adjacent the sidewall portion 50. The lower edges of the wheels 54 and 56 extend below the lower edge of the sidewall portion 50 so that the wheels 54 and 56 may be rolled over a generally planar surface, such as the floor 13 of the crematory furnace 10, with the lower edge of the sidewall portion 50 being in close proximity to, but not touching, the floor 13.

The reel 40 further includes a generally cylindrical portion 60 extending between the rollers 54 and 56 with a plurality of generally helical blades being formed on the cylindrical portion 60 and extending between the rollers 54 and 56.

An electric motor 64 having an output shaft 66 with a pully 68 mounted thereon is connected to the planar surface 48. A drive belt 70 passes through a slot 72 in the planar portion 48 and is in frictional engagement with the pulley 68 and the axle 42 for driving the reel 40 in rotary motion about the axle 42 whenever the motor output shaft 66 rotates. The motor 64 receives electrical power from electrical leads (not shown) extending between the housing 28 to the motor 64 in a manner which is similar to that used in the structure of conventional vacuum cleaners for driving attachments thereto.

A vacuum line 74 extends from the central portion of the planar surface 48, and a connector 76 connects the vacuum line 74 to the vacuum line 78. The connection 76 provides convenient means for permitting removal of the reel assembly 24 from the vacuum line 78 for cleaning, repair or replacement.

When the device 22 is in operation to remove cremated bone remains from the floor 13 of the crematory furnace 10, the blower 30 draws a partial vacuum through the vacuum lines 74 and 76. The vacuum lines 74 and 76 are preferably formed of a heat resistant material such as stainless steel. In order to permit convenient movement of the reel assembly 24 within the crematory furnace 10, a flexible hose section 80 connects the vacuum line 78 to the housing 28. When the motor 64 drives the reel 40, the cutting blades 62 contact cremated bone remains in the crematory furnace 10 and break them into fragments sized appropriately for removal from the crematory furnace 10 through the vacuum lines 74, 78, and 80. The helical blades 62 include sharp cutting edges 81 for engaging the cremated bone remains for breaking into pieces small enough for removal from the crematory furnace 10 through the vacuum line 74.

Referring to FIGS. 1 and 2, the blower 30 exhausts air through an exhaust outlet 82 to draw air through the reel assembly 24 and the vacuum lines 74, 78 and 80. After air enters the housing 28 through the vacuum line 80, the air moves past the filter array 32 to remove fine dust particles of cremated remains from the intake air. Pieces of the cremated remains that are too large to enter the filter array 32 drop into a hopper 84 positioned below the filter array 32. The hopper 84 may be formed as a truncated pyramid terminating in a flange 86, which is connected to a corresponding flange 88 that extends from a grinder housing 90.

Figure 6:
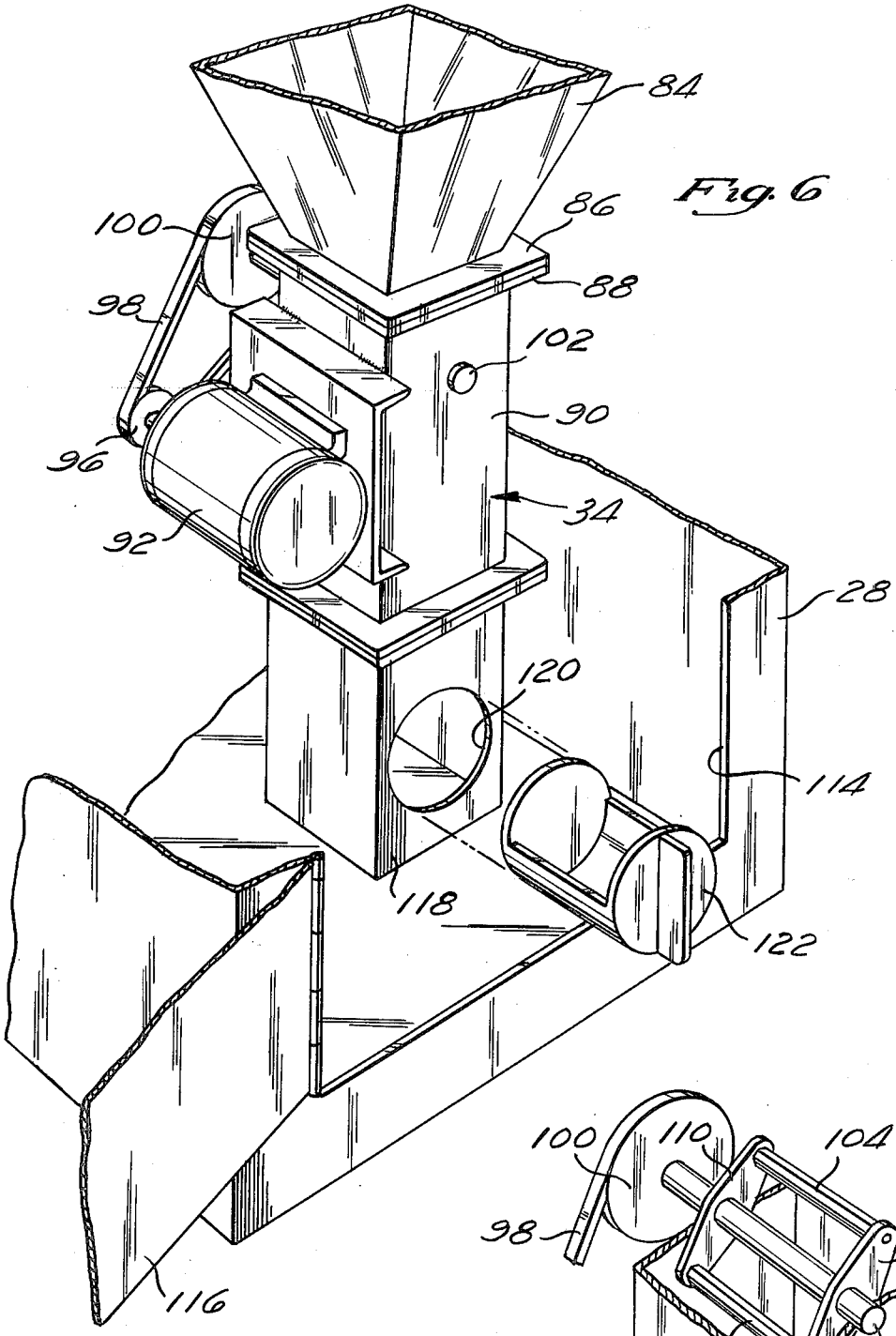
FIG. 6 is a cut away perspective view taken of the apparatus of FIG. 2.
Figure 7:
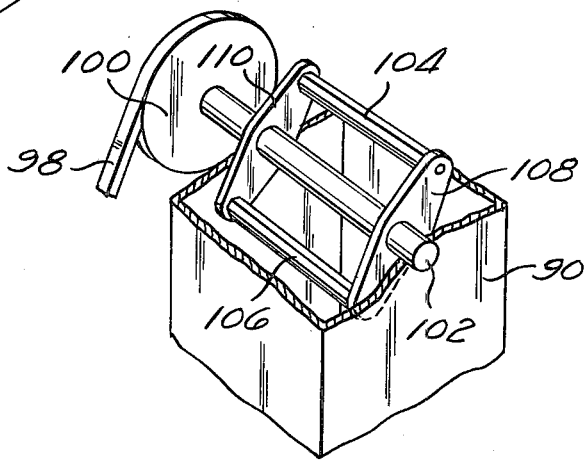
FIG. 7 is a partial cut away perspective view showing the interior of the apparatus of FIG. 6 for grinding cremated remains of bone fragments.

As shown in FIGS. 2 and 6, a grinder motor 92 is mounted on the exterior of the grinder housing 90 outputs rotational energy to a shaft 94 having a pulley 96 mounted thereon. The pulley 96 is frictionally engaged with a drive belt 98, which is also frictionally engaged with a pulley 100 mounted to a shaft 102 that extends from the grinder housing 90. Referring to FIGS. 6 and 7, the shaft 102 extends into the grinder housing 90 to mount a pair of rotatable grinder elements 104 and 106 therein. A pair of brackets 108 and 110 are centrally mounted spaced apart upon the shaft 102 with the grinder elements 104 and 106 being connected to the brackets 108 and 110 such that the grinder elements 104 and 106 are parallel to and spaced apart from the shaft 102. The brackets 108 and 110 are preferably formed such that the grinder elements 104 and 106 may be conveniently mounted on opposing sides of the shaft 102.

Referring to FIGS. 1, 2 and 6, the housing 28 includes an opening 112 therein to provide access to the blower 30, the grinder motor 92 and other parts of the system enclosed within the housing 28. The housing 28 further includes a second opening 114, which is ordinarily covered by a door 116.

The door 116 provides access to a receptacle housing 118, which has an opening 120 therein for permitting a receptacle 122 to be selectively positioned in or removed from the receptacle housing 118. As the pieces of cremated bone remains move from the hopper 84 into the grinder housing 90, the cremated bone remains are ground into relatively small particles, which fall below the rotating grinder element 104 into the receptacle 122.

Substantially all of the pieces of cremated bone remains removed from the interior of the crematory furnace 10 are either collected in the filter array 32 or ground in the grinder assembly 34 and thence collected in the receptacle 122. After all remains are removed from the crematory furnace 10 and the grinding process is completed, particles collected in the filter array 32 are transferred to the receptacle 122.

FIGS. 4 and 5 illustrate a portion of the filter array 32 and means for removing entrapped cremated bone particles therefrom. A shaft 124 is rotatably mounted in the housing 28, and a rod 126 connects a handle 128 to the shaft 124 to provide convenient means for rotating the shaft 124. A length of angle iron is mounted to the shaft 124 to form a cam 130, which is essentially parallel to the shaft 124. Rotation of the shaft 124 rotates the cam 130 to alternately lift and drop a portion of the filter array 32. The effect of rotating the cam shaft 130 is to shake the filter array 32 and to cause material entrapped in the filter array 32 to fall into the hopper 84 and thence into the receptacle 122.

Therefore, by using the reel assembly 24 to break and remove cremated bone remains from the crematory furnace 10 and using the filter array 32 and grinder assembly 34, essentially all of the remains are removed from the crematory furnace 10 and collected as relatively fine particles in the receptacle 122. Therefore, the survivors of the deceased person whose body was cremated in the crematory furnace 10 are assured of obtaining essentially all of the material which remained after cremation of the body.

Although the present invention has been described with reference to a particular embodiment thereof, it should be understood by those skilled in the art that numerous modifications may be made without departing from the scope and spirit of the invention. Accordingly, all modifications and equivalents which are properly within the scope of the appended claims are included in the present invention.

What is claimed is:

1. A system for removing remains from a crematory furnace, comprising:
- means for breaking cremated remains into fragments less than a predetermined size;
- a vacuum line having a first end connected to said breaking means;
- a housing connected to a second end of said vacuum line;
- a blower connected to said vacuum line to form a partial vacuum therein to draw material from said breaking means into said housing for removing the fragments from the crematory furnace; and
- means for collecting fragments output from said removing means.

2. The system of claim 1 wherein said housing includes a filter array therein for collecting selected fragments of the cremated bone remains.

3. The system of claim 2 further including means for selectively removing fragments collected within said filter array for input into said collecting means.

4. The system of claim 3 further including:
- a cam rotably mounted within said housing adjacent a portion of said filter array; and
- means for rotating and said cam to vibrate said filter array for removing material within said filter array from said filter array for input into said collecting means.

5. A system for removing remains from a crematory furnace, comprising:
- a reel housing;
- a reel rotatably mounted within said reel housing, said reel including a plurality of blades formed thereon for engaging said breaking cremated bone remains;
- means for driving said reel to break the cremated bone remains into fragments for removal from the crematory furnace;
- means for removing the fragments from the crematory furnace; and
- means for collecting fragments output from said removing means.

6. The system of claim 1 further including means for grinding fragments of calcinated bone remains received from said removing means into small particles.

7. The system of claim 6 wherein said grinding means includes:
- a grinder housing; and
- a grinder element rotatably mounted within said grinder housing for contacting material input thereto for breaking the material into small pieces for input into said collecting means.

8. The system of claim 7 further including:
- a grinder motor; and
- means for connecting said grinder motor and said grinder element to rotatably drive said grinder element.

9. A method for removing cremated bone remains from a crematory furnace, comprising the steps of:
- breaking the cremated remains into fragments; and
- forming a partial vacuum in a vacuum line having an input end positioned within the crematory furnace adjacent the fragments of the calcinated bone remains for removing the fragments from the crematory furnace.

10. The method of claim 9 further including the steps of:
- grinding the fragments into small particles; and
- collecting the small particles in a receptacle.

11. The method of claim 9 further including the steps of filtering the output of the vacuum line.

12. The method of claim 11 further including the step of transferring material filtered from the vacuum line into the receptacle.

* * * * *